United States Patent [19]

Hommes

[11] 3,938,217

[45] Feb. 17, 1976

[54] SURFACE CLEANING PICKUP HEAD

[75] Inventor: Jack L. Hommes, Muskegon, Mich.

[73] Assignee: Clarke-Gravely Corporation, Muskegon, Mich.

[22] Filed: Nov. 5, 1973

[21] Appl. No.: 412,668

[52] U.S. Cl. ..... 15/346; 15/419; 15/421

[51] Int. Cl.[2] ..... A47L 5/14

[58] Field of Search ..... 15/346, 340, 345, 419, 15/421

[56] References Cited

UNITED STATES PATENTS

| | | | |
|---|---|---|---|
| 784,801 | 3/1905 | Moorhead | 15/345 |
| 3,005,224 | 10/1961 | Magarian | 15/421 |
| 3,089,178 | 5/1963 | Sherman | 15/421 |
| 3,491,399 | 1/1970 | Dolan et al. | 15/346 |

*Primary Examiner*—Harvey C. Hornsby
*Assistant Examiner*—James A. Niegowski
*Attorney, Agent, or Firm*—Price, Heneveld, Huizenga & Cooper

[57] ABSTRACT

The specification discloses a surface cleaning apparatus having an air blast pickup head in which the suction in the exhaust chamber can be increased by the operator during operation of the apparatus to facilitate the ingestion of larger objects of debris and litter.

17 Claims, 5 Drawing Figures

SURFACE CLEANING PICKUP HEAD

BACKGROUND OF THE INVENTION

The present invention relates to surface cleaning apparatus, and particularly to such apparatus employing air assist or air blast pickup heads.

Air assist pickup heads deliver air under pressure to an exhaust chamber. The air under pressure sweeping over the surface being cleaned tends to loosen debris which is then exhausted through an exhaust line joined to the exhaust chamber. A sweeper having a pickup head of this type is disclosed in U.S. Pat. No. 3,512,206, issued to Mr. B. W. Young on May 19, 1970. The exhaust chamber is enclosed on all sides so that it is somewhat sealed with respect to the atmosphere. The front wall of the exhaust chamber is sealed by means of a flexible flap which allows debris and the like to pass thereunder and into the exhaust chamber.

This type of pickup head is quite effective as a result of the employment of a blast of air to loosen dirt on the surface to be cleaned. In order to keep dust and the like to a minimum, it is fairly important that the exhaust chamber be relatively well sealed with respect to the atmosphere. Thus, dust and debris kicked up by the air blast are exhausted from the exhaust chamber without escaping to any great extent to the air. Typically, some air is drawn in from the atmosphere from the side walls and front flap of the exhaust chamber as a result of the fact that a small bleed-off is inherent in the flow circuit. Some of the air which is drawn out of the exhaust chamber by the blower is exhausted to the atmosphere, as a result of a small amount of unavoidable leakage, rather than being returned to the air delivery plenum chamber with the bulk of the air. Typically, such bleed-off amounts to about 1% of the air being circulated and is probably never more than 5 to 10%. In some systems, a bleed-off port is purposely provided for bleeding off these small amounts of air.

One drawback to such a system is that the pickup head does not readily ingest larger articles of debris and the like. The front flap of exhaust chamber is flexible so that theoretically large items of debris and litter can be drawn thereunder. As a practical matter, however, such ingestion poses a mettlesome and heretofore unsolved problem.

SUMMARY OF THE INVENTION

In the present invention, a vent and a closure means therefor are provided in the air delivery circuit which delivers air under pressure to the surface being cleaned. The closure means is operably connected to an actuating means which is positioned so as to be accessible to the operator of the apparatus. The vent itself is sufficiently large that a substantial volume of air under pressure can be exhausted therethrough. When the operator approaches a large article of debris, he activates the actuating lever, thereby causing a substantial volume of air to be vented to the atmosphere rather than to be delivered into the exhaust chamber of the pickup head. As a result, the relative vacuum within the exhaust chamber is increased substantially and sharply so that larger articles of debris and litter are more readily sucked thereinto and exhausted through the exhaust circuit.

Preferably, the front flap on the exhaust chamber is also operably connected to the actuating means so that when the actuating means is actuated by the operator, the front flap is pivoted upwardly to some extent. Thus, the front flap is mechanically pivoted upwardly as well as being drawn upwardly by the sudden increase in vacuum within the exhaust chamber so that the pickup of large items of litter and debris is still more readily effected.

These and other objects, advantages and features of the present invention will be more fully understood and appreciated by reference to the written specification and appended drawings.

DESCRIPTION OF THE PREFERRED EMBODIMENT

Figure 2:
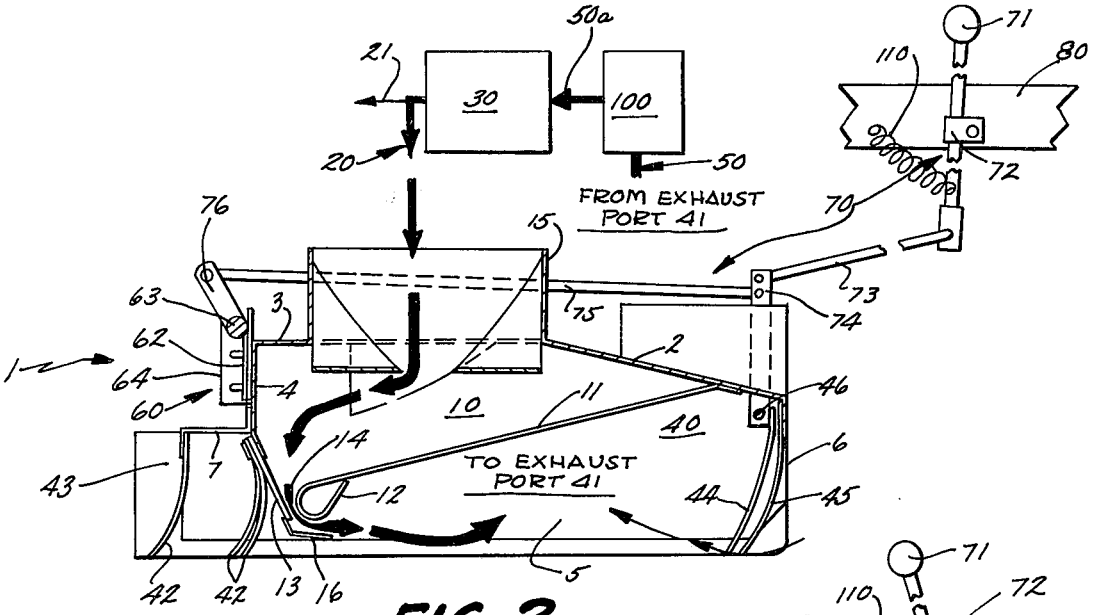
FIG. 2 is a cross-sectional view of the pickup head taken along plane II—II of FIG. 1 with the flow surface for the air being shown schematically and with only a representative portion of the frame of the surface cleaning apparatus being shown.

In the preferred embodiment, the surface cleaning apparatus of the present invention includes an air assist Pickup head 1 which is in flow communication with a blower 30 through an air delivery line 20 and through an air exhaust line 50 (air delivery line 20, blower 30 and exhaust line 50 being shown schematically in FIG. 2). Pickup head 1 includes an air delivery plenum chamber 10 to which air under pressure first enters the pickup head. From there it is blasted through an air blast nozzle 14 into the pickup head exhaust chamber 40. From thence it is exhausted through exhaust line 50. The vent holes 61 of a plenum vent assembly 60 (FIGS. 2 and 4) can be opened by actuating an actuator linkage 70 so that a substantial volume of air in air delivery plenum 10 is exhausted through vent holes 61, thereby creating a greater vacuum within exhaust chamber 40 and causing a greater volume of air to be drawn in under the primary front flap 44 and the secondary front flap 45 at the front of exhaust chamber 40. (Compare FIGS. 2 and 3).

Pickup head 10 itself includes a sheet of metal bent into a front wall 6, a sloping top wall 2, a generally horizontal top wall 3 and a rear wall 4 (FIGS. 1 through 5). The ends of pickup head 1 are closed off by a pair of spaced end walls 5 (see particularly FIGS. 1 and 4). The end walls 5 are also constructed of metal and are secured to the front, top and rear wall defining sheet of metal by welding or the like.

Figure 1:
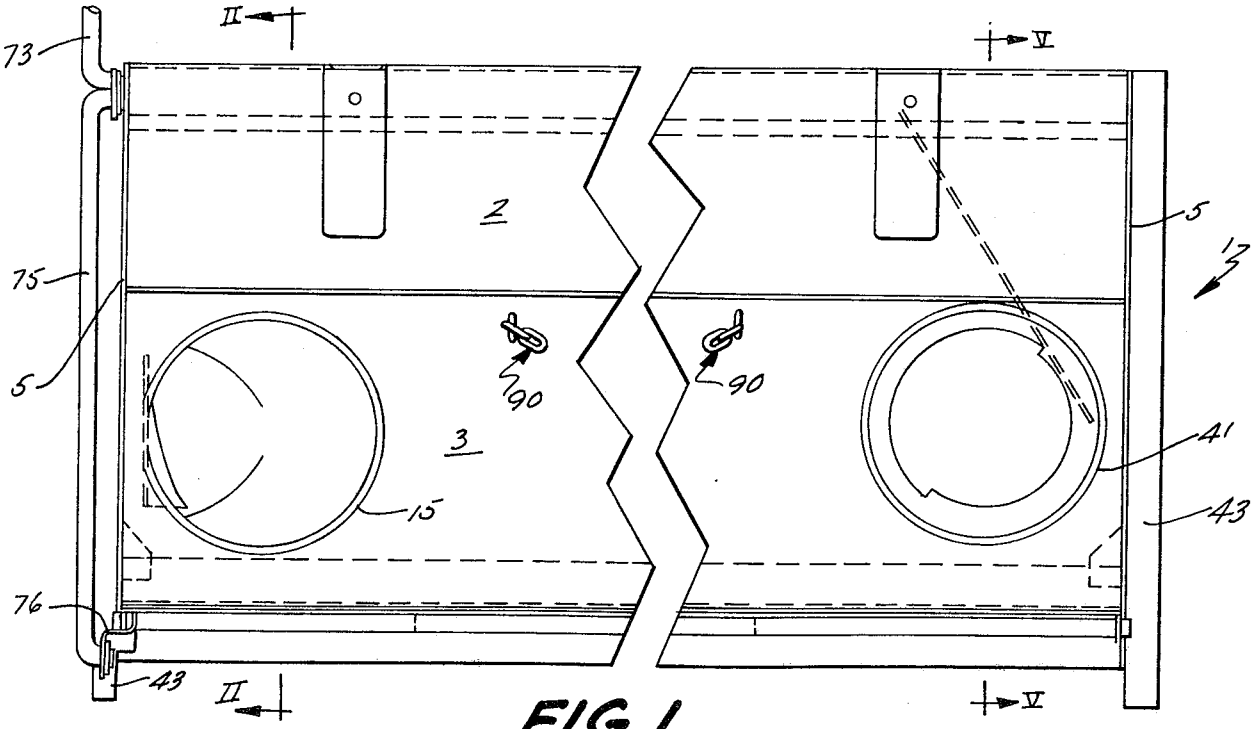
FIG. 1 is a plan view of the pickup head for the surface cleaning apparatus of the present invention.
Figure 3:
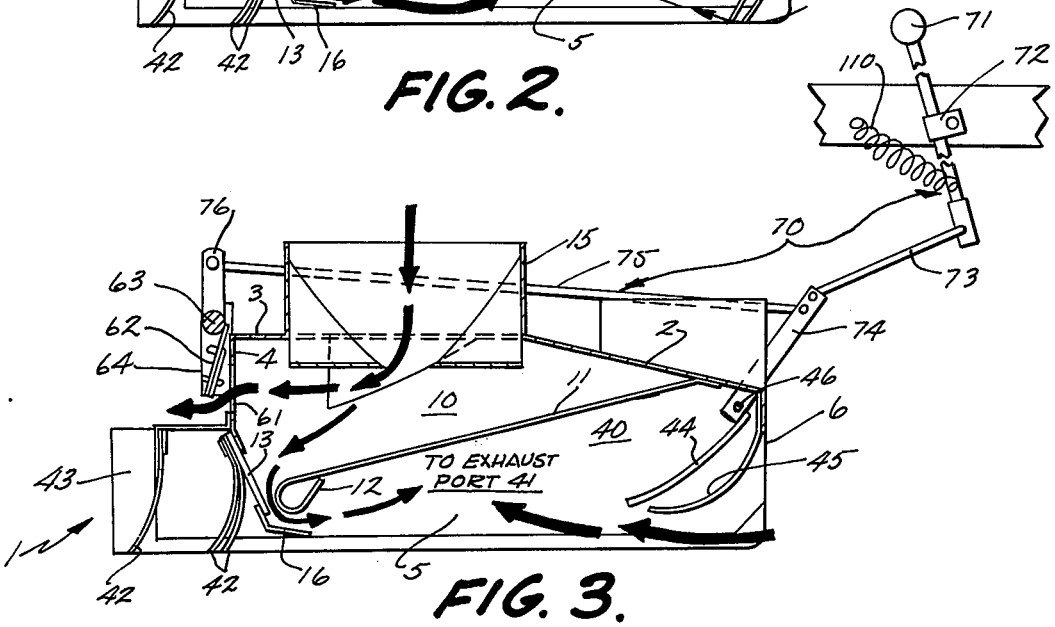
FIG. 3 is a cross-sectional view taken along plane II—II of FIG. 1 but with the actuator means in its open position so as to open the vent at the rear of the air delivery plenum and so as to partially lift the front flap at the front of the exhaust chamber.
Figure 5:
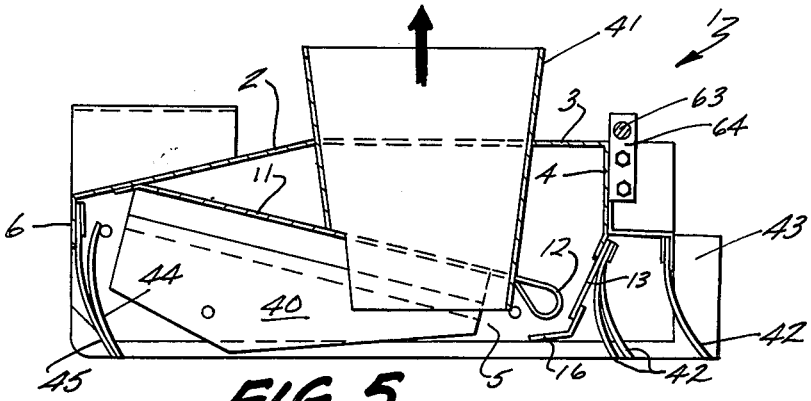
FIG. 5 is a cross-sectional view of the pickup head taken generally along plane V—V of FIG. 1.

The interior of pickup head 1 is divided into an air delivery plenum chamber 10 and an exhaust chamber 40 by means of a sheet metal partition 11 which is welded at its front near the front of top sloping wall 2. From its point of connection to wall 2, partition 11 slopes rearwardly and downwardly and is rolled over along its back edge to define a guide foil 12 (FIGS. 2, 3 and 5). There is an opening through top horizontal wall 3 into air delivery plenum 10, and this opening is fitted with a suitable air delivery port 15 to which an air delivery line 20 can be connected (FIGS. 1, 2 and 3). Joined to the bottom edge of rear wall 4 is a downwardly and slightly forwardly sloping air guide flange 13 which terminates at a point spaced a short distance from air guide foil 12. The space between air guide flange 13 and air guide foil 12 comprises a long nozzle 14 between air delivery plenum chamber 10 and exhaust chamber 40 and extending from one end wall 5 to the other. Air which enters air delivery plenum chamber 10 under pressure through port 15 is blasted forwardly and downwardly through nozzle 14 and into the rear of exhaust chamber 40. A small bracket 16 is welded to each end wall 5 of pickup head 1 for the purpose of supporting air guide flange 13 at its ends so as to insure an appropriate angle for delivering the blast of air downwardly and forwardly along the rear of exhaust chamber 40.

Figure 4:
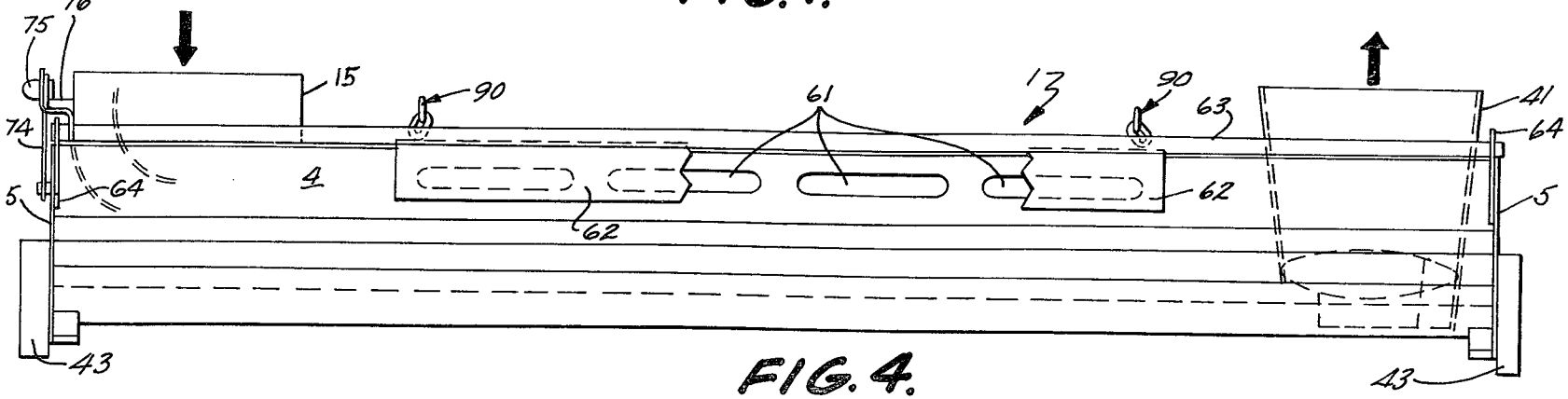
FIG. 4 is a rear elevational view of the pickup head.

Exhaust chamber 40 is exhausted by blower 30 through an exhaust port 41 (FIGS. 1, 4 and 5). Exhaust port 41 is a sheet metal cylinder which is fitted through an opening in top horizontal wall 3 and which extends downwardly through air delivery plenum chamber 10, through an aperture in the top of partition 11 and into exhaust plenum 40 at one end thereof. Air delivery port 15 is located at the opposite end of pickup head 1 so that air not only sweeps into exhaust chamber 40 along its rear edge, but also tends to sweep from one end thereof toward the other, i.e. towards exhaust port 41 (FIG. 1). An exhaust line 50 is connected to exhaust port 41 and empties into a debris plenum 100. Debris plenum 100 is connected by a flow passage 50*a* to the exhaust generating side of blower 30.

Exhaust chamber 40 is generally sealed with respect to the atmosphere by means of a set of three rear sealing flaps 42 and by a pair of front flaps, specifically primary front flap 44 and secondary front flap 45 (FIGS. 2, 3 and 5). The rear flaps 42 are made of fairly thin rubber or the like and two of them are connected to the bottom of rear wall 4 along with air guide flange 13. The third flap 42 is mounted on a projecting rear ledge wall 7 which is welded to rear wall 4 and which projects generally outwardly horizontally from rear wall 4.

Primary front flap 44 is a fairly heavy flap made of rubber or the like and it is mounted to a pivot axle 46 which is mounted at its ends in suitable bearings, the bearings in turn being mounted in apertures in the end walls 5. Secondary front flap 45 is lighter in weight than primary front flap 44 and it is secured directly to forward wall 6. The heavier flap 44 provides the primary seal along the front of exhaust chamber 40 whereas the secondary lighter flap 45 is intended more for insurance. The ends of exhaust chamber 40 are sealed off not only by end walls 5, but also by a pair of shoes 43, one being mounted against each end wall 5 (FIGS. 1–5). The shoes 43 are made of wood, nylon, teflon or a material such as carborundum. These shoes 43 actually engage the surface to be cleaned to generally seal off the ends of exhaust chamber 40.

In stating that exhaust chamber 40 is generally sealed with respect to the atmosphere, it is by no means intended to imply that any type of perfect seal is formed. Indeed, air is continually allowed to leak under front flaps 44 and 45, and in fact under all of the walls of exhaust chamber 40, in order to insure a slight flow of air from the exterior to the interior of exhaust chamber 40 and thereby minimize dust pollution. Absent such a slight flow of air into exhaust chamber 40, dust and the like might actually be blown out from under the walls of exhaust chamber 40. This slight leaking of air into exhaust chamber 40 from the atmosphere is created by an inherent air bleed-off, shown schematically by arrow 21, on air delivery line 20 (FIG. 2). This bleed-off is of about 1% of the air being circulated.

With the exception of the slight bleed-off 21, the air flow system in this apparatus is generally closed and continuous. Thus, air is fed from blower 30 into air delivery plenum chamber 10 and from thence into exhaust chamber 40 from whence it is exhausted through exhaust port 41 (not shown in FIG. 2), through exhaust line 50 and back to blower 30.

Plenum vent 60 is located on the rear wall 4 of air delivery plenum chamber 10 (FIGS. 2, 3 and 4). A plurality of elongated holes 61 are located in rear wall 4. These holes 61 are sufficiently large that when opened, a substantial amount of air is vented from air delivery chamber 10 directly to the atmosphere. This amounts preferably to about 25% of the air being circulated in the system. Vents 61 are normally closed, however, by a closure door 62. Door 62 is a piece of sheet metal which is secured by welding or the like to a pivot axle 63. Axle 63 is pivotally mounted in a pair of mounting brackets 64, one being located at each end of pickup head 1, each of the brackets 64 being bolted to one of the end walls 5. Elongated bolt holes are provided in brackets 64 to facilitate adjustment of closure door 62 with respect to its vent holes 61.

Pivot axle 63 of closure 62 is in turn operably connected to actuating linkage 70. Actuator linkage 70 includes a handle 71 which is pivotally mounted in a pivot mounting bracket 72 to the frame 80 of the surface cleaning apparatus (FIGS. 2 and 3). A front tie rod 73 is pivotally connected to the end of handle 71 at a point which is located below pivot mounting bracket 72. Tie rod 73 is in turn connected to a front flap actuating lever 74. The connection is a pivotal one and is made by bending the front tie rod 73 over at its end, passing it through a hole in the flap actuating lever 74 and securing it by means of a lock washer or other conventional means. Flap lever 74 is itself securely fastened to the front flap pivot mounting axle 46. Thus, when flap lever 74 is rotated from its upright position to a forwardly sloping position (compare FIGS. 2 and 3), pivot axle 46 is rotated and front flap 44 tends to be pivoted upwardly.

A rear tie rod 75 is also pivotally connected to front flap lever 74 and extends rearwardly where, at its opposite end, it is pivotally connected to a closure actuating lever 76. Closure actuating lever 76 is bent inwardly from its point of connection with rear tie rod 75 and is then bent downwardly and is rigidly connected at its other end to the pivot axle 63 of closure door 62 (FIG. 4). When an operator pulls handle 71 rearwardly, he pulls flap lever 74 forwardly and he pulls closure door lever 76 forwardly, thereby tending to pivot heavy primary flap 44 upwardly and rearwardly and thereby opening closure door 62 of vent 60. A spring means 10 is mounted at one end to frame 80 and at its other end to lever 71 in order to normally bias lever 71 to a forward position as shown in FIG. 2.

The frame 80 on which pickup head 1 and actuating lever 71 are mounted may be the frame of any of a number of different types of movable carts or vehicles. Thus, pickup head 1 could be incorporated into a walk behind type of sweeper, it could be incorporated into a ride-on sweeper or it could be incorporated into a large truck. Pickup head 1 is mounted to the frame 80 of the particular vehicle by means of chains or the like extending between frame 80 and a pair of spaced mounting links 90 (FIG. 1).

OPERATION

In operation, closure door 62 of the plenum vent apparatus 60 would normally be closed. Thus, air from blower 30 would normally be blasted throughport 15 into air delivery plenum 10 and from thence through nozzle 14 into the rear of exhaust chamber 40 (FIG. 2). The path of this air is indicated by heavy dark arrows in FIG. 2. A very small arrow represents the 1% or so air bleed-off 21 in order to graphically illustrate the fact that the amount of air bled off is extremely minor compared to the overall flow generated by blower 30. FIG. 2 also shows that bleed-off 21 results in a small amount of air being drawn in under primary front flap 44 and secondary front flap 45. This minor flow of air is indicated by very small, fine arrows of FIG. 2. All of the air which so enters exhaust chamber 40 is then evacuated outwardly through exhaust port 41 (not shown in FIGS. 2 and 3) and is from thence returned to blower 30 through exhaust line 50.

As the operator of the surface cleaning apparatus approaches a large item of litter such as a paper cup or a popcorn box, he pulls handle 71 rearwardly. This opens vent holes 61 at the rear of air delivery plenum chamber 10. Also, it pivots primary front flap 44 upwardly to some extent. The opening of the vent holes 61 allows a substantial voluem of air to escape from air delivery chamber 10 into the atmosphere (FIG. 3). This escape of a substantial volume of air is indicated by the path of the very heavy dark arrows in FIG. 3. Since some air still passes through nozzle 14 into exhaust chamber 40, a series of small arrows are shown in FIG. 3 passing through nozzle 14 and into exhaust chamber 40. However since a very substantial amount of air escapes through the vents 61, about 25% of the air being circulated, a rather substantial vacuum with respect to the atmosphere is suddenly built up within exhaust chamber 40. This causes a great deal of air to be drawn in under the front flaps 44 and 45. This sudden rush of air not only facilitates further lifting of heavy primary front flap 44, it also causes secondary front flap 45 to be lifted upwardly and it carries the item of debris or litter, such as cup or popcorn box, underneath flaps 44 and 45 and into exhaust chamber 40. Then, such items of debris and litter are readily drawn up through exhaust line 50 to a suitable debris chamber 100 which is located in the flow circuit of exhaust line 50.

Once such items have been ingested, the operator releases lever 71 so that it returns to the position shown in FIG. 2. The vent holes 61 of plenum vent assembly 60 are again closed and primary front flap 44 and secondary front flap 45 again assume their positions as shown in FIG. 2.

This assembly greatly improves the utility of air assist pick-up heads since it provides the dust loosening advantages of such pick-up heads and still makes possible the ingestion of larger items of litter and debris. Of course, it will be understood that various changes and alterations can be made in the preferred embodiment without departing from the spirit and broader aspects of the invention as defined in the appended claims.

The embodiments of the invention in which an exclusive property or privilege is claimed are defined as follows:

1. A surface cleaning apparatus comprising: a pickup head defining an exhaust chamber; an air delivery flow circuit operably connected to said exhaust chamber for delivering air under pressure to said exhaust chamber; an air exhaust circuit operably connected to said exhaust chamber for exhausting air therefrom; a vent on said air delivery circuit for venting said air delivery circuit to the atmosphere, said vent being located outside of said exhaust chamber and on the upstream air flow side thereof; said vent being sufficiently large to vent a substantial portion of air under pressure to the atmosphere; closure means on said vent; actuating means operably connected to said closure means and being conveniently located on said apparatus for actuation by an operator operating said surface cleaning apparatus whereby as said pickup head approaches large items of debris, the operator can open said vent by actuating said actuating means, to create a greater negative pressure in said exhaust chamber with respect to the atmosphere whereby the ingestion of large items of debris and litter is facilitated.

2. The apparatus of claim 1 in which said exhaust chamber includes sealing means extending generally to the surface being cleaned for generally sealing said exhaust chamber with respect to the atmosphere; said sealing means including a front flap, pivotally mounted along the front of said exhaust chamber; said actuating means being operably connected to said front flap whereby the actuation of said actuating means by the operator also tends to raise said front flap.

3. The apparatus of claim 2 in which said front flap comprises a relatively heavy primary flap; said sealing means further including a secondary flap which is lighter than said primary flap and which is mounted at the front of said exhaust chamber in front of said primary flap.

4. The apparatus of claim 2 in which said pickup head also defines an air delivery plenum chamber, said air delivery plenum chamber comprising a part of said air delivery flow circuit; said pickup head including a wall defining said air delivery plenum chamber and closing said air delivery plenum chamber to the atmosphere; said vent means comprising at least one aperture in said wall.

5. The apparatus of claim 4 in which said closure means comprises a door pivotally mounted on an axle adjacent said vent means; a lever rigidly connected to said axle; said actuating means including a handle pivotally mounted on said surface cleaning apparatus and linkage means joining said handle to said closure lever; said front flap being mounted on an axle which is pivotally mounted in said pickup head; a front flap actuating lever being rigidly connected to said front flap pivot axle; said front flap actuating lever being operably connected to said linkage means.

6. The apparatus of claim 1 in which said pickup head also defines an air delivery plenum chamber, said air delivery plenum chamber comprising a part of said air delivery flow circuit; said pickup head including a wall defining said air delivery plenum chamber and closing said air delivery plenum chamber to the atmosphere; said vent means comprising at least one aperture in said wall.

7. The apparatus of claim 1 in which said closure means comprises a door rigidly mounted on a pivot axle; a closure actuating lever being rigidly connected to said pivot axle; said actuating means including a handle pivotally mounted to said surface cleaning apparatus and a linkage operably connected to said handle and operably connected to said closure actuating lever whereby the operation of said handle opens said door of said closure means.

8. The apparatus of claim 1 in which said vent is sufficiently large to vent approximately 25% of the air which would otherwise be delivered to said exhaust chamber.

9. The apparatus of claim 8 in which said exhaust chamber includes sealing means extending generally to the surface being cleaned for generally sealing said exhaust chamber with respect to the atmosphere; said sealing means including a front flap, pivotally mounted along the front of said exhaust chamber; said actuating means being operably connected to said front flap whereby the actuation of said actuating means by the operator also tends to raise said front flap.

10. The apparatus of claim 1 in which said exhaust chamber includes sealing means extending generally to the surface being cleaned for generally sealing said exhaust chamber with respect to the atmosphere; said sealing means including a front flap, pivotally mounted along the front of said exhaust chamber; said actuating means being operably connected to said front flap whereby the actuation of said actuating means by the operator also tends to raise said front flap.

11. A surface cleaning apparatus comprising a pickup head; said pickup head including an air delivery plenum chamber and a separate exhaust chamber, said air delivery chamber being in flow communication with said exhaust chamber through an air blast nozzle means; blower means for generating a vacuum on one side thereof and for generating air under pressure on the other side thereof; an air delivery line operably connected to said blower means on said pressure generating side thereof and operably connected to said air delivery plenum chamber of said pickup head; an exhaust flow line operably connected to said exhaust chamber of said pickup head and operably connected to said blower means on said suction generating side thereof; a debris collecting chamber being operably connected to said exhaust line between said exhaust chamber and said blower means; vent means in said air delivery plenum chamber for venting said air delivery plenum chamber to the atmosphere; said vent means being sufficiently large to vent a substantial portion of air under pressure to the atmosphere; closure means on said vent means for normally closing said vent means; actuating means operably connected to said closure means and being conveniently located for actuation by an operator operating said surface cleaning apparatus whereby when said pickup head approaches a large debris, the operator can open said vent means by actuating said actuating means and thereby opening said closure on said vent means, thereby creating a greater negative pressure in said suction chamber of said pickup head.

12. The apparatus of claim 11 in which said pickup head includes sealing means extending generally to the surface being cleaned whereby said pickup head is generally sealed with respect to the atmosphere.

13. The apparatus of claim 12 in which said sealing means includes a front flap pivotally mounted to said pickup head; said actuating means being operably connected to said front flap whereby when the operator opens said closure means on said vent, he simultaneously pivots said front flap upwardly towards an open position, thereby facilitating the ingestion of large articles of debris and litter underneath said front flap into said exhaust chamber of said pickup head.

14. The apparatus of claim 13 comprising: said vent means being sufficiently large to vent a substantial portion of air under pressure to the atmosphere whereby a substantial decrease is experienced in the relative pressure in said exhaust chamber.

15. The apparatus of claim 14 in which said vent is sufficiently large to vent approximately 25% of the air which would otherwise be delivered to said exhaust chamber.

16. The apparatus of claim 11 comprising: said vent means being sufficiently large to vent a substantial portion of air under pressure to the atmosphere whereby a substantial decrease is experienced in the relative pressure in said exhaust chamber.

17. The apparatus of claim 16 in which said vent is sufficiently large to vent approximately 25% of the air which would otherwise be delivered to said exhaust chamber.

* * * * *